US006883460B2

(12) United States Patent
Weisenfeld

(10) Patent No.: US 6,883,460 B2
(45) Date of Patent: Apr. 26, 2005

(54) FILE MARKING DEVICE

(76) Inventor: Neil Lawrence Weisenfeld, 33 Middle La., Westbury, NY (US) 11590

( * ) Notice: Subject to any disclaimer, the term of this patent is extended or adjusted under 35 U.S.C. 154(b) by 0 days.

(21) Appl. No.: 10/628,190

(22) Filed: Jul. 28, 2003

(65) Prior Publication Data

US 2005/0022718 A1 Feb. 3, 2005

(51) Int. Cl.[7] ..... G09F 9/00

(52) U.S. Cl. ..... 116/313; 116/303; 116/307; 116/309; 116/319; 116/234

(58) Field of Search ..... 116/313, 234, 116/303, 306, 307, 309, 319, 200; 283/36, 37, 39, 41; 40/359, 641, 492

(56) References Cited

U.S. PATENT DOCUMENTS

| | | | | | |
|---|---|---|---|---|---|
| 709,640 | A | * | 9/1902 | Kravik | 40/341 |
| 958,050 | A | | 5/1910 | Whipple | |
| 1,008,352 | A | | 1/1911 | Meyers | |
| 1,031,321 | A | * | 7/1912 | Cahn | 116/311 |
| 1,048,577 | A | * | 12/1912 | Pardoe | 116/234 |
| 1,193,265 | A | * | 8/1916 | Honecker | 40/641 |
| 1,310,468 | A | * | 7/1919 | Best | 116/234 |
| 1,314,425 | A | * | 8/1919 | Quigley | 40/391 |
| 1,481,173 | A | * | 1/1924 | Wright | 40/359 |
| 1,544,818 | A | | 7/1925 | Dawson | |
| 1,596,225 | A | | 8/1926 | Anderson | |
| 1,654,545 | A | | 1/1928 | Lindsay | |
| 1,688,965 | A | * | 10/1928 | Heiland | 116/324 |
| 1,697,985 | A | * | 1/1929 | Lindsay | 116/234 |
| 1,697,988 | A | | 1/1929 | Monamara | |
| 1,751,495 | A | | 3/1930 | Robinson | |
| 2,610,604 | A | * | 9/1952 | Edwards | 116/319 |
| 2,969,793 | A | | 1/1961 | Furrer et al. | |
| 3,132,628 | A | * | 5/1964 | Gehlsen | 116/319 |
| 3,958,752 | A | * | 5/1976 | Pieszchala | 232/35 |
| 4,143,477 | A | | 3/1979 | Reynolds | |
| 4,176,485 | A | * | 12/1979 | Terris | 116/319 |
| 4,255,888 | A | | 3/1981 | Bastogne | |
| 5,160,296 | A | | 11/1992 | Katz | |
| D331,598 | S | | 12/1992 | Martin | |
| 5,639,124 | A | | 6/1997 | Jung | |
| 5,836,098 | A | | 11/1998 | Carney | |
| 5,918,955 | A | | 7/1999 | Graham | |
| 5,942,293 | A | | 8/1999 | Ochipinti et al. | |
| 5,953,843 | A | | 9/1999 | Collins et al. | |
| D438,904 | S | | 3/2001 | Reynolds | |
| 6,354,027 | B1 | | 3/2002 | Cummings | |

* cited by examiner

*Primary Examiner*—Christopher W. Fulton
*Assistant Examiner*—Travis Reis

(57) ABSTRACT

A file marker device adapted for use with a folder. The folder to which the device can be affixed comprises a front flap having a first top edge, a rear flap connected to the front flap by a folder bottom, the rear flap having a second top edge. Hanging folders often also comprise a plurality of equally spaced parallel slots near at least a first or second top edge. The file marker device can comprise a support portion having two opposed end tabs, each of the end tabs being capable of engaging one of the plurality of equally spaced parallel slots; and an indicator arm moveably attached to the support portion, the indicator arm being moveable about a pivot point from a first position to a second position. In some embodiments the file marker device also comprises a shield portion and/or a portion adapted for exhibiting identifying indicia.

13 Claims, 3 Drawing Sheets

FILE MARKING DEVICE

FIELD OF THE INVENTION

This invention relates to improvements in file folders, expandable folders, hanging folders, and the like. In particular, this invention relates to devices for marking placement of files removed from predetermined locations.

BACKGROUND OF THE INVENTION

Folders for holding files and papers, often termed file folders, have become a necessity in today's modern offices and businesses. Such folders may be simply stiff, folded paperboard, having predetermined cut out or raised areas for attaching labels or other identifying indicia. File folders, such as manila folders, are useful for storing paper and related articles in an orderly manner in file drawers or cabinets. Many improvements have been made to the simple file folder, including expandable folders that can hold a large amount of papers, reinforced edges for stronger, longer lasting use, and clasp means for positively securing the file contents so that enclosed papers stay organized and do not fall out.

Many variations of the simple file folder are known. For example "file pockets" are expandable file folders having fan-folded sides for higher capacity storing of papers. File pockets come in a variety of sizes, including letter and legal size. "Expanding files" are similar to file pockets, but generally have a flap attached that can be secured to a front cover to prevent papers from falling out the top of the file. Expanding files often have numerous pockets inside which are sometimes indexed for added organizational capability. Closely related to expanding files are expanding wallets, which generally have an elastic cord attached to the flap which can be used to secure the flap in a closed position.

In addition to simple file folders, file pockets, expanding files and expanding wallets, it is known to use hanging folders for receiving file folders, loose papers, and the like. Hanging folders are made for use in standard storage units such as file cabinets, desk drawers and the like. Hanging folders are generally formed of a sheet of heavy weight paper with a central horizontal fold which forms the folder's bottom and has open sides. Folds are provided in the file's top edges through which hanging rods are movably or immovably fixed. The ends of these rods are exposed and notched, enabling the file to hang by the exposed rods on a complementary standard parallel file frame in office storage equipment, such as filing cabinets and desk drawers. In addition, the folded portion near the top edges can have a series of spaced apart, parallel slots adapted to receive and removeably hold labeling devices, such as clear plastic holders made to hold paper tags with identifying indicia thereon.

File folders are often stored together with other file folders in an upright, vertical orientation, with the opening oriented upwardly for relatively easy retrieval of the contents. For example, file drawers can be fitted with suitable support structures to hold a plurality of hanging files. Such files are often hung in a closely-packed series of adjacent folders in a certain order, for example, arranged alphabetically. Often it is necessary to remove one or more files to access the contents therein.

One drawback to the use of existing file folders such as hanging folders is the relatively time consuming activity of replacing such folders once removed from a file drawer. Once the user removes a file from a predetermined location among other files, it requires time and effort to find the place the file came from when returning the file to the drawer. Since usually all the hanging folders have a similar appearance, the user must closely inspect the identifying indicia, if any, on each hanging folder in the vicinity of the series of folders from which the removed file was taken. This activity is not only time consuming, but it can be frustrating, since extra time taken to identify the location of a hanging folder is usually at the expense of other pressing office activities. Additionally, the chance of the removed file being replaced in the wrong position is high, adding to further delays in office activities the next time that file is to be needed.

Many different methods are known to mark the position of files removed from a set of files. For example, one such method is to place a self-stick note, such as one sold under the trademark Post-it® sold by 3M, on an adjacent folder prior to removing the desired folder. However, such notes can fall off over time.

Another method is disclosed in U.S. Pat. No. 5,942,293, issued Aug. 24, 1999 to Occhipinti et al. The Occhipinti file marker comprises a clip body adapted to clip to a file rail as used for hanging files. However, such a device is useful only for hanging files using such a file rail. Similarly, U.S. Pat. No. 1,596,225, issued Aug. 17, 1926 to Andersson discloses an indicating device for filing drawers made to clip onto the side of a file drawer. The device incorporates an indicating blade arranged to swing from a first position into a second position in which it lies between papers in a file drawer. However, the device of Andersson must be adapted to a certain type of file drawer, and may not be suitable for use with hanging files commonly used today. A file spacing and indicating device that is made for hanging files used today is disclosed in U.S. Pat. No. 5,918,955, issued Jul. 6, 1999 to Graham. The device of Graham requires a separate mounting rod on which a plurality of separators are provided. However, many users of hanging files would not want to retrofit the hardware associated with existing hanging files in the manner required for the Graham device.

Other approaches for indicating the location of removed files and folders rely on the placement of a marker on or between adjacent files and/or folders. For example, U.S. Pat. No. 6,354,027, issued Mar. 12, 2002 to Cummings discloses a T-shaped marker that can be slid in between file folders in the place of a removed folder. However, such a device can become misplaced, may not be readily available when needed, and doesn't allow the file drawer to be closed when it is in place. A similar device addressing the problem of misplacement of the marker is disclosed in U.S. Des. Pat. No. 331,598, issued Dec. 8, 1992 to Martin. The device of Martin is very similar to that of Cummings, but it is made to hang on the top edge of a file folder, and apparently is magnetic or otherwise adapted to stick to the side of a metal file cabinet. Still another device made to be readily available for marking the place of a removed file from a cabinet drawer is disclosed in U.S. Pat. No. 5,836,098, issued Nov. 17, 1998 to Carney. The device of Carney can be placed between two non-removed files to mark the position of a removed file. The device is also disclosed as being readily available by being stored magnetically on the metal surface of the file cabinet. However, the device of Carney, being wedge-shaped can be bulky, taking up valuable file space if very many devices are necessary.

Known filing systems also include indicating means to display information relating to the contents of various file folders. Indicating means of various forms are commonly used; some being fixedly attached to the file folder via tabs that slip into slots among other methods. For example, U.S. Pat. No. 1,008,352, issued Nov. 14, 1911 to Meyers discloses a tab for card index systems which pivots directly on the card. U.S. Pat. No. 1,654,545, issued on Jan. 3, 1928 to Lindsay discloses a pivoting signal tab for file folders. U.S. Pat. No. 5,341,982, issued on Aug. 30, 1994 to Syers discloses a file folder having a pivoting tab for indicating folder contents during horizontal and vertical stowage. However, such pivoting indicating means for file folders fails to address the need to efficiently find the location to replace papers removed from file folders or file folders removed from file systems. Many such indicating means, having the purpose of indicating the contents of the file must be displayed continuously (in the raised position) and hence cannot be used to differentiate a single file or paper having been removed from a group. Additionally, such devices do not address the need to easily and efficiently install, remove or change the location of indicating means among various types of file folders and the like. Further, such devices, with their fixed position indicating means, do not address the need for such indicating means to coexist with the existing indicating means used on file folders such as indicating tabs with paper inserts.

Accordingly, it would be desirable to have a file marker that can be attached to a file folder such that it cannot be misplaced.

Additionally, it would be desirable to have a file marker that can be attached, even removeably attached, to existing file folders.

Additionally, it would be desirable to have a file marker that is easy to use, making it easy to mark the placement of hanging folders and the like, as well as allowing closure of the drawer and easy manipulation of files.

Additionally, it would be desirable to have a file marker that can be used with any folders without the need to modify associated hardware, such as hanging rods, drawers and the like.

Additionally, it would be desirable to have a file marker that can be retrofitted to existing file folders and can easily coexist and not interfere with existing indicating means used on file folders.

Further, it would be desirable to have a file marker that can be inexpensively and easily manufactured using commonly available materials.

SUMMARY OF THE INVENTION

A file marker device adapted for use with a folder is disclosed. The folder to which the device can be affixed comprises a front flap having a first top edge, a rear flap connected to the front flap by a folder bottom, the rear flap having a second top edge. Hanging folders often also comprise a plurality of equally spaced parallel slots near at least a first or second top edge. The file marker device can comprise a support portion having two opposed end tabs, each of the end tabs being capable of engaging one of the plurality of equally spaced parallel slots; and an indicator arm moveably attached to the support portion, the indicator arm being moveable about a pivot point from a first position to a second position. In some embodiments the file marker device also comprises a shield portion and/or a portion adapted for exhibiting identifying indicia.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
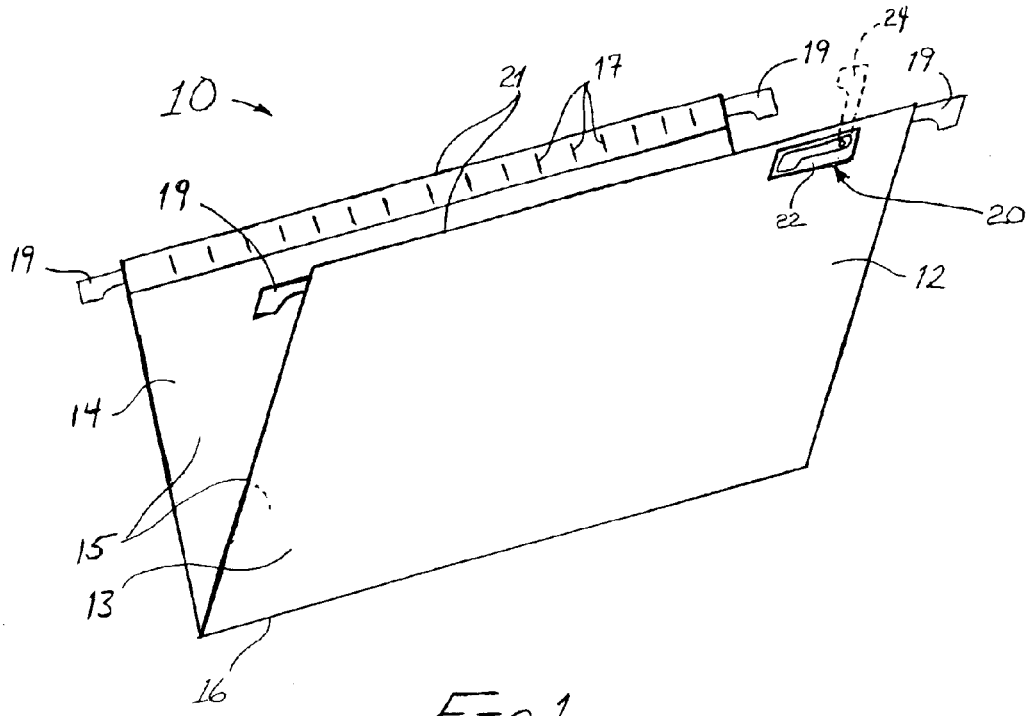
FIG. 1 is a perspective view of a typical file folder, specifically a hanging folder having a file marker of the present invention disposed thereon.

As used herein, when used alone, the term "folder" encompasses all of "file folders," "file pockets," "expanding files," "expanding wallets," and "hanging folders" as well as other folding articles that may be stored in a file drawer or cabinet, such as hanging ring binders, bound presentation folders, and the like.

As used herein, the term "file folder" means folders such as manila, kraft, pressboard, or plastic, typically supplied in letter or legal size. File folders come in a variety of "points", which denote the weight of the paper stock used for the folder. File folders are supplied with various improvements, such as color coding, undercut tabs for labeling, reinforcing strips along edges, and fasteners to hold papers attached in various positions. By way of example, a manila file folder suitable for the present invention is the Smead 152L heavyweight 11 pt. manila folder, available from the Smead company, Hastings, Minn.

As used herein, the term "file pockets" means expandable pockets having fan-folded sides and a fan-folded bottom, useful for large files. File pockets can have a larger capacity than file folders, and may be used in standard filing systems, including hanging files. By way of example, file pockets suitable for the present invention is the Wilson Jones 64 series 3½ inch expansion COLORLIFE® file pocket, from the Wilson Jones Company, or the Smead 1524E Redrope® Pockets. File pockets are often reinforced to provide maximum durability and capacity.

As used herein, the term "expanding files" means expandable file folders, generally having a fan-folded bottom, full fan-folded sides, and a fold-over flap that is used to securely close the file. By way of example, an expanding file suitable for the present invention is the 21-pocket Smead DR117A expanding file with flap, available from the Smead company.

As used herein, the term "expanding wallets" means expandable file folders similar to expanding files. Expanding wallets generally have elastic cord tie flaps for securely closing a top flap. By way of example, expanding wallets suitable for the present invention include the Oxford Plus® 60343 3½ inch expansion reinforced wallets.

As used herein, the term "hanging folder" means folders designed for use with hanging file systems. Such folders come in many variations including box-bottom, expandable, color-coded, and reinforced-edge, durable designs. By way of example, hanging folders suitable for the present invention include standard size folders such as the Esselte Pendaflex® 4152 series (letter size) and 4153 series (legal size) folders; box bottom folders such as the Esselte Pendaflex® 4152X series (letter size) and 4153X series (legal size) folders; expanding file pockets such as the Smead 18H24ESS (letter size) and 18H26ESS (legal size) folders; and hanging expanding files such as the Globe-Weis GlobalFile® 85030 expanding hanging file. A further example of hanging folders of the type useful for the present invention is disclosed in U.S. Pat. No. 5,275,439 to Hawes, Jr. et al., issued Jan. 4, 1994.

Although a file marker of the present invention can be utilized on any folder as defined above, it will be described herein in the context of a preferred embodiment for use on a typical hanging folder. A typical embodiment of a hanging folder 10 is shown in FIG. 1. Hanging folder 10 has a front flap 12 connected to a rear flap 14 along a medial fold at folder bottom 16. Each flap 12 and 14 has an exterior surface 13 and an interior surface 15, respectively. In use, folder bottom 16 is disposed horizontally, generally parallel to top edges 21. Hanging folder 10 is primarily distinguished from other file folders by hanging rods 19, which are movably or immovably fixed to top edges 21. The ends of rods 19 are exposed and typically notched, enabling the file to hang on a complementary standard parallel file frame in filing drawers or cabinets. Hanging folders also typically have means for attaching or mounting identifying indicia, the means including, for example, spaced apart, vertically-oriented slits, or slots, 17 near one or both of the top edges 21 of flaps 12, or 14.

Figure 2:
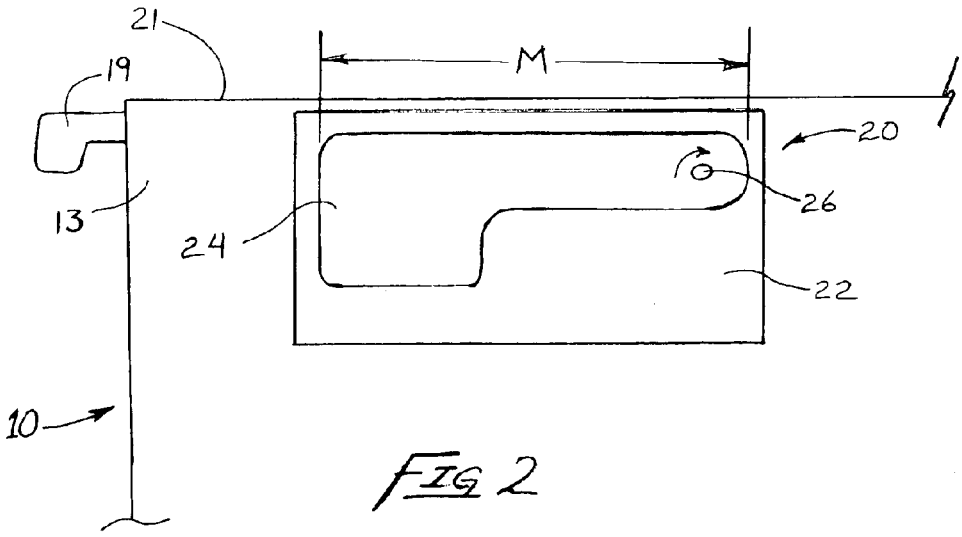
FIG. 2 is a side view showing one embodiment of a file marker of the present invention.

One embodiment of a file marker 20 of the present invention is shown in FIG. 1, mounted on the exterior surface 13 near one of the top edges 21 of flaps 12, or 14. As shown in more detail in FIG. 2, the file marker 20 of the present invention comprises a support portion 22 and an indicator arm 24 moveably attached to the support portion 22. The indicator arm is preferably elongated. By "elongated" as used in the context of the indicator arm 24, is meant that the indicator arm 24, when viewed as in FIG. 2, has a non-circular profile, and preferably has an identifiable major dimension M, as shown in FIG. 2, which can be, for example, the length dimension of a rectangular-shaped indicator arm 24. Other shapes for indicator arm 24 can include ovoid, elliptical, or modified rectangle, e.g., flag shaped, as shown in FIG. 2.

The file marker 20 of the present invention can be mounted such that indicator arm 24 can be moveable from a first position in which it is disposed generally parallel to top edge 21, and preferably entirely below top edge 21, as shown in FIG. 2. In general, "below" as used herein relative to the top edge 21 means below with respect to the typical usage of folders in which the opening, and, therefore, the top edges, are generally oriented at the top of the folder in use. In use, therefore, a file marker 20 of the present invention can be substantially hidden from view when the indicator arm 24 is in its first position below top edge 21. Indicator arm 24 can be moved, e.g., by rotation about pivot point 26, to a second position in which indicator arm 24 is visible above top edge 21, as shown by dashed line in FIG. 1. As with the term "below," the term "above" is used in this context to mean above top edge 21 when folder 10 is in use. Pivot point can comprise any pivot means known in the art, including, without limitation metal eyelets, brads, rivets, and the like. In a preferred embodiment, a brass eyelet links support portion 22 and indicator arm 24 in a rotatably moveable relationship.

Support portion 22 can be attached to either exterior surface 13 or interior surface 15 of folder 10 by any convenient means. For example support portion 22 can be affixed by adhesive means, e.g., pressure sensitive adhesive, in an operative position with respect to the top edge 21. An operative position is a position in which indicator arm 24 is clearly visible above top edge 21 when in the second position. Preferably indicator arm 24 is not visible when in the first position, but may be somewhat visible, due to the relative position of the folder to which it is attached and the users line of sight. File marker 20 can be removeably attached, such as by reusable adhesives, such as those used on Post-It® notes. In one embodiment, file marker 20 is provided with pressure sensitive adhesive and a release paper strip that can be removed prior to placement and mounting on folder 10.

In another embodiment, file marker 20 can be attached to top edge 21. For example file marker 20 can have means for frictionally engaging the top edge, such as by clipping or snapping on. In one embodiment, the means for frictionally engaging is the same as is used for known file labeling devices that are made of clear plastic designed to slip onto, and to tightly hold to, top edge 21. In another embodiment file marker can comprise a metallic or plastic clip resembling a paper clip that can be clipped onto top edge 21. In any such embodiment, file marker 20 can be removeably attached for easy portability from one file to another, if desired.

As can be appreciated based on the description herein, when file marker 20 is mounted in operative position on a folder, such as hanging file 10, indicator arm 24 can be turned down in the first position. When the folder is used with other folders in a file drawer and indicator arm 24 is in the first position it is not clearly visible, and may not be visible at all, above the top edge 21 of hanging file 10. Therefore, when indicator arm 24 is in the first position it is in a ready position, but is not actually marking or indicating anything. When a folder adjacent to a folder comprising file marker 20 is removed from a storage position, e.g., from a file drawer, indicator arm 24 of file marker 20 on the adjacent folder remaining in the storage position can then be easily rotated into the upright second position to be visible above top edge 21 for clear viewing by the user. The indicator arm 24 of file marker 20 then clearly indicates to the user the position of the removed file so that when the user is ready to return the removed file to its proper place the user does not have to inspect individual files to find the right position for replacement. The user simply replaces the removed file adjacent the file having the upright indicator arm 24, which is then turned back down to its first position. File marker 20 is always ready for use, cannot be misplaced, and is easy to use.

Figure 3:
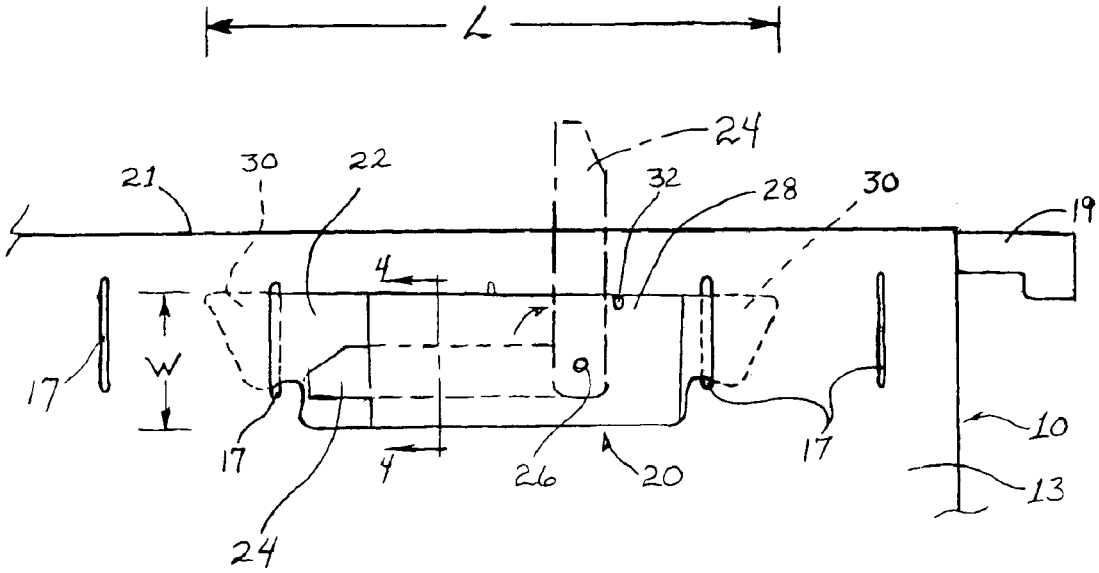
FIG. 3 is a side view of another embodiment of a file marker of the present invention mounted onto a hanging folder.

When used on the exterior surface 13 of folder 10, it is possible for removal of an adjacent file to inadvertently move the indicator arm 24 of a file marker 20. Likewise, when used on the interior surface 15 of folder 10, it is possible for papers being removed from folder 10 to inadvertently move the indicator arm 24 of a file marker 20. Therefore, as shown in FIG. 3 which shows another embodiment of file marker 20, file marker 20 can have a shield member 28 that can be a folded extension of support portion 22, as indicated in the cross-sectional view shown in FIG. 4. Shield member 28 covers at least a portion of indicator arm 24 to help prevent an adjacent folder, or associated papers, etc., from inadvertently pushing the indicator arm upward and into a visible or partially-visible position above top edge 21.

Figure 4:
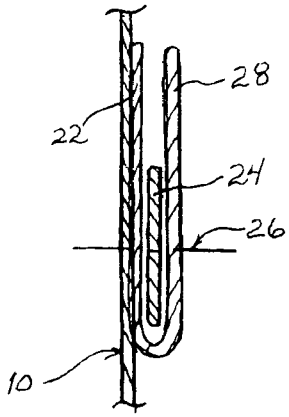
FIG. 4 is a cross-sectional view along Section 4—4 shown in FIG. 3.

As shown in FIG. 4, file marker 20 can be described as substantially U-shaped in cross-section comprising one leg of the U-shape being the support portion 22 and the other leg being the shield member 28. The indicator arm, preferably an elongated indicator arm, 24, can be rotatably connected to the U-shaped member at pivot point 26.

The embodiment shown in FIG. 3 is a preferred embodiment of file marker 20 and is shaped so as to be fitted into existing spaced-apart, parallel slits, or slots, 17 that are typically present on hanging files, for example as shown in FIG. 1. The spaced-apart, parallel slots 17 are provided on hanging folders to facilitate placement of flexible paper or plastic holders for identifying indicia. In like manner, a file marker 20 of the present invention can be suitable shaped to fit into these slots. Such a file marker 20, therefore, can be easily adapted for use on existing hanging files without the need for other attachment means such as adhesive. Because of the relatively small size of file marker 20, it may reside on a hanging file folder without interfering with the function, particularly the display properties, of existing display means used on the folder.

As shown in FIG. 3, a preferred embodiment of file marker 20 has a support portion 22 having a suitable shape for insertion into slots 17 of folder 10, referred to as "engaging" the slots. Support portion has two opposing end portions 30 that can be referred to as "tabs," each preferably identically shaped, and preferably having a shape designed for easy insertion into slots 17. Of course, the shape and size of file marker 20 and spacing of tabs 30 can be varied, being limited only by the size and spacing of slots 17. In a preferred embodiment, file marker can be about 2–4 inches long, that is, from one opposing end tab to the other opposing end tab in the dimension indicated as "L" in FIG. 3; and about ½–1 inch wide, that is, from top to bottom in the dimension marked "W" in FIG. 5. In a preferred embodiment, indicator arm 24 can preferably extend an inch to an inch and a half above top edge 21 when in the second, upright position, as shown in dashed line in FIG. 3. This extension size allows a standard file drawer to be opened and closed with indicator arm 24 in the upright position. Once inserted into slots 17, file marker 20 works as described above, having an indicator arm 24 moveable from a first down position to a second upright position in which it is clearly visible above top edge 21. As before, in a preferred embodiment, indicator arm is rotatably moveable about a pivot point 26, which can be made by any means known in the art, including by use of a metal eyelet.

In one embodiment, shield 28 and support portion 22 can be joined in a suitable position, such as the position marked as 32 to make a rotation limiting stop. Rotation limiting stop 32 can be, for example, a crimped portion of either shield 28 or support portion 22 or both. Rotation limiting stop 32 can also be a spot weld, spot bond, or other means of joining shield 28 and support portion 22, or otherwise blocking further movement of indicator arm 24 to prevent rotation of indicator arm 24 beyond a certain position. Rotation limiting stop 32 can provide a positive stop for indicator arm 24 when it is rotated through an angle of about 90 degrees, for example.

File marker 20 can comprise any suitable materials such as metal, paper, plastic or combinations of such materials. In a commercially viable embodiment that is relatively inexpensive to produce and relatively durable in use, file marker 20 comprises durable plastic. In harsh environments or for heavily used files, all or certain other components of file marker 20 can be made of metal, such as aluminum, steel, or brass. Pivot means 26 can include metallic components, such as the aforementioned brass eyelet. Support portion 22, indicator arm 24, and shield member 28, if used, are preferably made of durable plastic, preferably thermoplastic materials such as polyethylene (including LDPE, HDPE, and LLDPE), polypropylene, polystyrene, polyethylene terephthalate (PET polyester), vinyl and the like. The file marker 20 can be formed by means known in the art, including by hand. In a commercially-viable process, file marker 20 is made in a continuous process in which continuous strips of thermoplastic material having a suitable thickness are die cut into a unit piece, which, when folded along a longitudinal fold forms the support portion 22, including tabs 30 and/or shield 28, if used. The die-cut, folded plastic piece can then be fitted with indicator arm 24 and pivot means 26. If the file marker 20 is to be made to stick onto folder 10 by adhesive, such adhesive and, if desired, a release paper strip can be disposed on support member 22. The file marker can be packaged individually or together with a plurality of file markers 20.

Each component can be made out of paper products such as manila, kraft or other paper/file folder grade papers. In paper, plastic or metal, indicator arm 24 is preferably a colored material, such as a bright, highly visible color. Additionally, printed indicia, such as letters and numbers can be printed on any portion of file marker 20.

In general, file marker 20 can be made of sufficiently pliable materials so as to be flexible, particularly embodiments intended to engage slots 17 of hanging folders 10. For cost reduction purposes, the thickness of the constituent materials and components can be made as thin as is possible while retaining desired durability.

Figure 5:
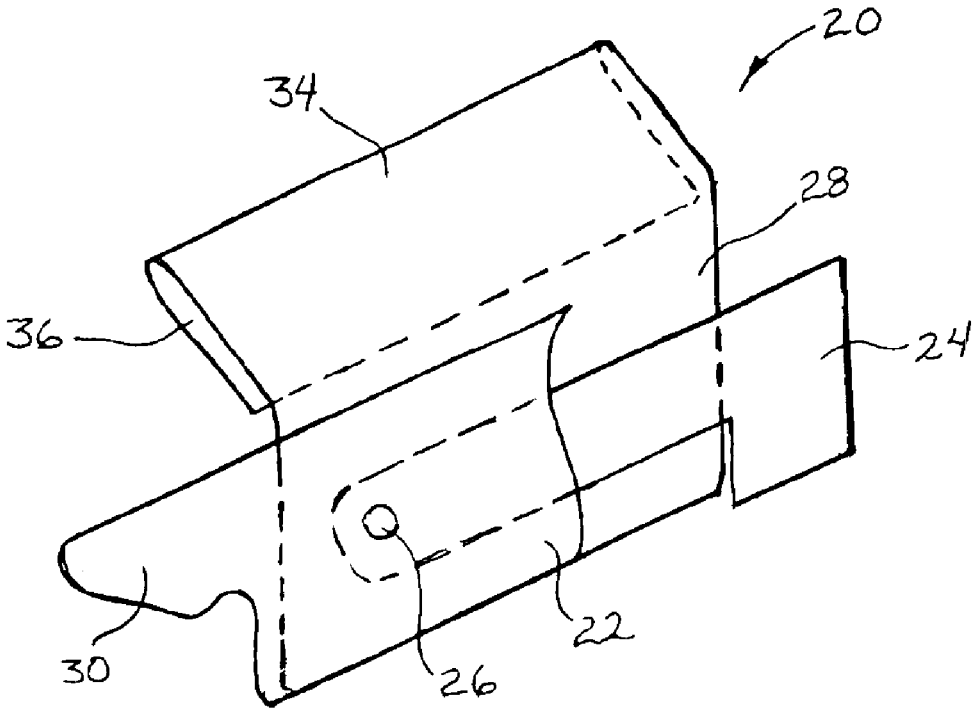
FIG. 5 is a partial cut-away perspective view depicting another embodiment of a file marker, namely a file marker adapted to display identifying indicia.

In one embodiment, as shown in the partially cut-away perspective view of FIG. 5, file marker 20 can be combined with other features, particularly a feature of providing the function of displaying identifying indicia, as is known to be useful in the art of hanging folders. In such an embodiment, an indicia receiving portion 34 of file marker 20 can be provided, which indicia receiving portion 34 is designed to extend permanently above top edge 21 in use and has at least one surface adapted to accept and display identifying indicia, such as file names, numbers, and the like. Generally this can be accomplished by the indicia receiving portion 34 being of clear plastic and having an opening, such as opening 36 in which paper strips having the identifying indicia visible thereon are slipped into place. The paper strips can be held in place by frictional engagement of opposing surfaces of indicia receiving portion 34.

As shown in FIG. 5, the indicia receiving portion 34 can be an extension of a shield 28, and can have a generally slanted orientation with respect to shield 28, as shown in FIG. 5, or it can be generally flat with respect to shield 28. In either embodiment, once tabs 30 are engaged with slots 17 (as shown in FIG. 3), file marker 20 can have the combined function of both providing identifying indicia for the folder to which it is mounted and providing marking means for adjacent folders.

While the above description contains many specificities, these should not be construed as limitations on the scope of the invention, but rather as illustrative of exemplary and preferred embodiments thereof. Many other variations are possible without departing from the spirit and scope of the invention as disclosed. Accordingly, it is intended to cover in the appended claims all such variations, changes, and modifications that are within the scope of this invention.

What is claimed is:

1. A file marker device for a folder comprising a front flap having a first top edge, a rear flap connected to the front flap by a folder bottom, the rear flap having a second top edge, the folder comprising a plurality of equally spaced parallel slots near at least a first or second top edge, the device comprising:

a support portion having two flexible, opposed end tabs, having suitable shade for insertion into said slots of said folder; and an indicator arm moveably attached to said support portion, said indicator arm being moveable about a pivot point trom a first position to a second position a shield member joined to and extending from said support portion, said shield member being in facing relationship with said support portion, and said indicator arm being disposed between said support portion and said shield portion.

2. The file marker device of claim 1, wherein said support portion and said indicator arm are comprised of a material chosen from the group consisting of: metal, paper, and plastic.

3. The file marker device of claim 2, wherein said support portion and said indicator arm are comprised of plastic chosen from the group consisting of: polyethylene, polypropylene, polystyrene, polyethylene terephthalate (PET polyester), vinyl and blends thereof.

4. A file marker device for a folder comprising a front flap having a first top edge, a rear flap connected to the front flap by a folder bottom, the rear flap having a second top edge, the file marker device comprising:

a support portion;

an elongated indicator arm rotatably connected to said support portion, said elongated indicator arm being rotatable from a first position to a second position in which said indicator arm is disposed substantially perpendicular to said first position; and attachment means for attaching said support portion to the folder near one of said first or second top edges of the front or rear flap a shield member joined to and extending from said support portion, said shield member being in facing relationship with said support portion, and said indicator arm being disposed between said support portion and said shield portion.

5. The file marker device of claim 4, wherein said attachment means comprises pressure sensitive adhesive.

6. The file marker device of claim 4, wherein said attachment means comprises means for frictionally engaging one of said first or second top edges of the front or rear flap.

7. The file marker device of claim 4, wherein said support portion and said indicator arm are comprised of a material chosen from the group consisting of: metal, paper, and plastic.

8. A file marker device for a folder comprising a front flap having a first top edge, a rear flap connected to the front flap by a folder bottom, the rear flap having a second top edge, the file marker device comprising:

a substantially U-shaped member comprising on one leg of said U-shaped member a support portion for attaching to one of said front or rear flaps, and on the other leg of said U-shaped member a shield member, an elongated indicator arm disposed interiorly of said U-shaped member and being rotatably connected to said U-shaped member, said elongated indicator arm being rotatable from a first position to a second position in which said indicator arm is disposed substantially perpendicular to said first position.

9. The file marker device of claim 8, wherein said support portion comprises two opposed flexible end tabs.

10. The file marker device of claim 8, wherein said U-shaped portion is comprised of a material chosen from the group consisting of: metal, paper, and plastic.

11. The file marker device of claim 10, wherein said support portion and said indicator arm are comprised of plastic chosen from the group consisting of: polyethylene, polypropylene, polystyrene, polyethylene terephthalate (PET polyester), vinyl and blends thereof.

12. The file marker device of claim 8, wherein said U-shaped portion comprises an adhesive material on one surface thereof.

13. The file marker device of claim 8, wherein said device comprises clear plastic for receiving paper strips.

* * * * *